United States Patent [19]

Kawaguchi et al.

[11] Patent Number: 4,640,081

[45] Date of Patent: Feb. 3, 1987

[54] AUTOMATIC PACKAGING APPARATUS

[75] Inventors: Masashi Kawaguchi, Yokohama; Masaru Yasumune, Mihara, both of Japan

[73] Assignee: Kabushiki Kaisha Furukawa Seisakusho, Tokyo, Japan

[21] Appl. No.: 738,098

[22] Filed: May 24, 1985

Related U.S. Application Data

[63] Continuation-in-part of Ser. No. 378,656, May 17, 1982, abandoned.

[30] Foreign Application Priority Data

May 23, 1981 [JP] Japan ..... 56-78351

[51] Int. Cl.[4] ..... B65B 31/02

[52] U.S. Cl. ..... 53/510; 53/251; 53/373; 198/463.3; 198/528; 198/535

[58] Field of Search ..... 53/251, 373, 434, 510, 53/511, 522; 198/463.3, 528, 535

[56] References Cited

U.S. PATENT DOCUMENTS

| | | | |
|---|---|---|---|
| 3,094,825 | 6/1963 | Bracey et al. | 53/512 |
| 3,699,742 | 10/1972 | Giraudi | 53/512 X |
| 3,958,391 | 5/1976 | Kujubu | 53/512 X |
| 4,164,111 | 8/1979 | Bernardo | 53/512 X |
| 4,176,506 | 12/1979 | Landolt | 53/512 X |
| 4,471,599 | 9/1984 | Mughai | 53/512 X |

FOREIGN PATENT DOCUMENTS

| | | | |
|---|---|---|---|
| 2519774 | 11/1976 | Fed. Rep. of Germany | 53/434 |
| 1032182 | 6/1966 | United Kingdom | 53/511 |
| 2058707 | 4/1981 | United Kingdom | 53/512 |

*Primary Examiner*—Paul A. Bell
*Assistant Examiner*—Steven P. Weihrouch
*Attorney, Agent, or Firm*—Ladas & Parry

[57] ABSTRACT

An automatic packaging apparatus has a bag forming device for automatically forming bags each containing one or more articles and a vacuum sealing device for sealing open ends of the bags in a vacuum. The vacuum sealing device has a plurality of bag supporting devices revolving synchronously with the feeding device and having respective pillow heads for resting thereon the open ends of the bags and vacuum covers each cooperating with a respective one bag supporting device to form one vacuum box in which the open end of the bag is sealed by and between a heating member provided in the vacuum box and the pillow head. Further the pillow head or a platform of the bag supporting device is moved vertically.

13 Claims, 22 Drawing Figures

AUTOMATIC PACKAGING APPARATUS

This application is a continuation in part of our prior application Ser. No. 378,656, filed May 17, 1982, now abandoned entitled AUTOMATIC PACKAGING APPARATUS, which is currently pending.

BACKGROUND OF THE INVENTION

This invention relates to an automatic vacuum packaging apparatus in which the operations of forming bags from a long sheet or strip of plastic film, simultaneously enwrapping articles or commodities to be packaged within the film bags, and sealing the openings of the bags with interiors in the state of a vacuum are continuously and automatically performed.

A revolving type vacuum packaging apparatus for placing meat or the like into bags made of plastic film and sealing the openings of the bags under a vacuum is disclosed, for example, in U.S. Pat. No. 3,958,391. This vacuum packaging apparatus has a plurality of vacuum boxes continuously moving along a circular endless rail, in each of which the opening of a bag containing one or more articles is sealed in the state of a vacuum during one revolution of each vacuum box along the rail. In this vacuum packaging apparatus, each of the operations such as opening and closing the vacuum boxes, adjusting air pressures in the boxes, heating for sealing the openings of the bags made of thermoplastic film and taking the sealed bags out of the vacuum boxes is automatically performed. However, the articles to be packaged cannot be automatically put into the bags, and the bags already containing the articles cannot be automatically fed into the vacuum boxes. That is, these two operations are performed manually, and it is especially difficult for a worker to put the articles such as meat into the bags in a short time.

In order to automatically feed the bags into the vacuum boxes, it is considered to convey each bag with its one open end on a conveyor belt from which the bag is transferred automatically into each vacuum box rotating around a sprocket in synchronism with the movement of each bag. In this case, when the bag is transferred from the belt conveyor into each vacuum box, it should be transferred smoothly. If there is a big difference in height between the conveyor belt and each vacuum box, the bag is apt to be laid on the platform of each vacuum box in an irregular posture. Accordingly, the open end of each bag is not laid on a pillow head in a regular posture thereby undesirably preventing the open end thereof from closing tightly when it is sealed in the vacuum box.

SUMMARY OF THE INVENTION

It is an object of this invention to provide an automatic packaging apparatus wherein the operations of forming a plastic film in the form of a long sheet or strip (hereinafter referred to as strip) into a tube of the plastic film while articles are fed into the plastic tube, cutting the tubular plastic film at appropriate intervals to form bags each containing one or more articles therein and having one closed end and one open end, and sealing the open end of each of bags in a vacuum box can be automatically and successively performed and each bag can be transferred smoothly from a conveyor belt for conveying each bag with its one open end into each vacuum box, whereby the number of workers for each apparatus can be remarkably decreased and the open end of each bag can be sealed tightly.

According to this invention there is provided an automatic packaging apparatus comprising: a bag forming device for automatically forming bags each containing at least one article; and a vacuum sealing device for sealing open ends of the bags in a vacuum; said bag forming device further comprising a tubular film forming device in the shape of a tube for continuously forming an elongated sheet of film into a tube of the film and wrapping the articles fed into the tubular film forming device in a line, a film sealing and cutting device for cutting the tube of film at preset space intervals to form each of the bags, one end of which is completely sealed and the other end of which is partly sealed, and a feeding device for feeding the bags formed by the film sealing and cutting device to the vacuum sealing device at a faster speed than that of the travel of the tube, said vacuum sealing device further comprising at least one bag supporting device, revolving synchronously with the feeding device so that each bag supporting device can receive a respective one bag fed by the feeding device along a traveling path and having a pillow head for resting thereon the open end of said bag fed onto the bag supporting device, each bag supporting device having a plate-like supporting member on which the bag is laid, and which is at a height position close to the lower surface of the feeding device to decrease the distance of drop between the feeding device and the plate-like supporting member which each bag is transferred from the feeding device onto the supporting member, either the pillow head or the supporting member being moved vertically relative to each other so that the pillow head is in a higher position than that of the supporting member to cause the open end of the bag to lie horizontally on the pillow head when the open end thereof is sealed, at least one vacuum cover, cooperating with each bag supporting device to form a vacuum box in which the open end of the each bag is sealed under a vacuum and revolving synchronously with said bag supporting device while moving vertically to open and close said vacuum box, said vacuum cover having a heating member for sealing the open end of the each bag, and a device for evacuating the inner space of the vacuum box.

The nature, utility, and further features of this invention will be more clearly apparent from the following detailed description with respect to a preferred embodiment of the invention when read in conjunction with the accompanying drawings.

DETAILED DESCRIPTION OF THE INVENTION

Figure 1:
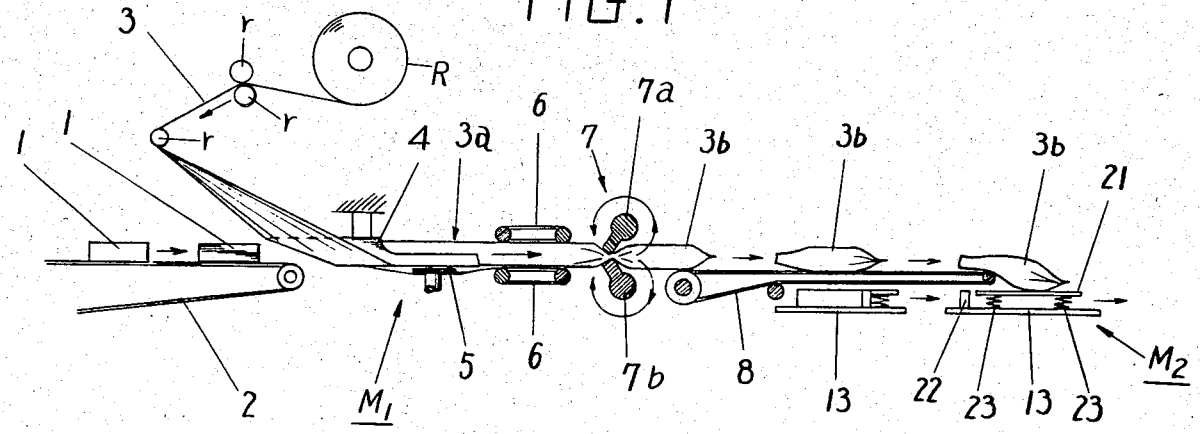
FIG. 1 is a schematic view, in side elevation, showing an example of the automatic packaging apparatus according to this invention.

Referring first to FIG. 1, an automatic packaging apparatus, according to this invention, has a bag forming device $M_1$ for forming bags of thermoplastic film as it simultaneously enwraps articles or commodities such as meats, fish, vegetables and the like and a vacuum-sealing device $M_2$ for sealing the open ends of the bags in a vacuum.

The bag forming device $M_1$ comprises a first feeding conveyor belt 2 for feeding the articles 1, 1, . . . 1 placed thereon at preset intervals, a known tubular film forming device 4 for continuously forming the strip 3 of plastic film led out of a film roll R via guide rollers r,r,r into a tube 3*a* thereof while the articles 1 are successively inserted into the tube 3*a*, a pair of sealing rolls 5 for joining the two-side edges of the strip 3 by heating thereby to complete the formation of the tube 3*a*, a pair of guide conveyor belts 6,6 placed apart in the vertical direction, for guiding the tube 3*a*, and a film sealing and cutting device 7 for cutting the tube 3*b* at appropriate intervals to form the bags in such a manner that the upstream ends of the bags relative to the flow direction of the bags are fully closed by being heat-sealed by the device 7, but a part of the downstream ends of the bags are open, and a second feeding conveyor belt 8 for feeding the bags processed by the device 7 into the vacuum sealing device $M_2$.

Figure 2:
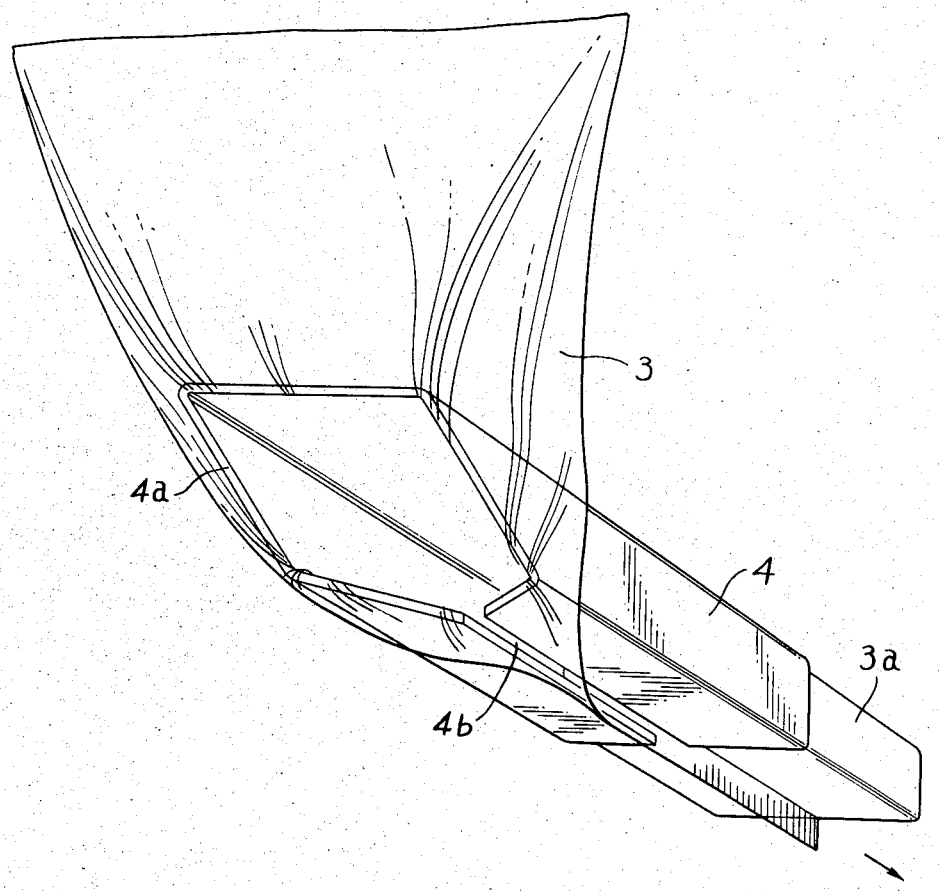
FIG. 2 is a perspective view showing a tubular film forming device in the apparatus for forming a film in sheet or strip form into a tubular film.

The tube forming device 4 is in the shape of a tube of substantially rectangular cross section as shown in FIG. 2, which device 4 has an inclined face 4*a* at its upstream end and a narrow slit 4*b*, extending in its longitudinal direction in its lower wall. The strip 3 of film is led into the device 4 through the inclined rear face 4*a* and thereby guided into the shape of the tube 3*a*. The two lateral edges of the strip 3 are thus brought together to hang through and from the slit 4*b* parallelly to each other. These hanging edges of the tube 3*a* are then joined to each other by being heat-sealed by the sealing rolls 5.

The articles 1 are continually fed at preset intervals into the device 4 through the same inclined face 4*a*. Thus, the articles 1 are positioned in the tube 3*a* at specific intervals and are thereby enwrapped or enfolded by the strip 3 as it is being shaped into the tube 3*a* as described above. The tube 3*a* containing the articles 1 therein is pulled by the guide conveyor belts 6,6 toward the film sealing and cutting device 7.

Figure 3:
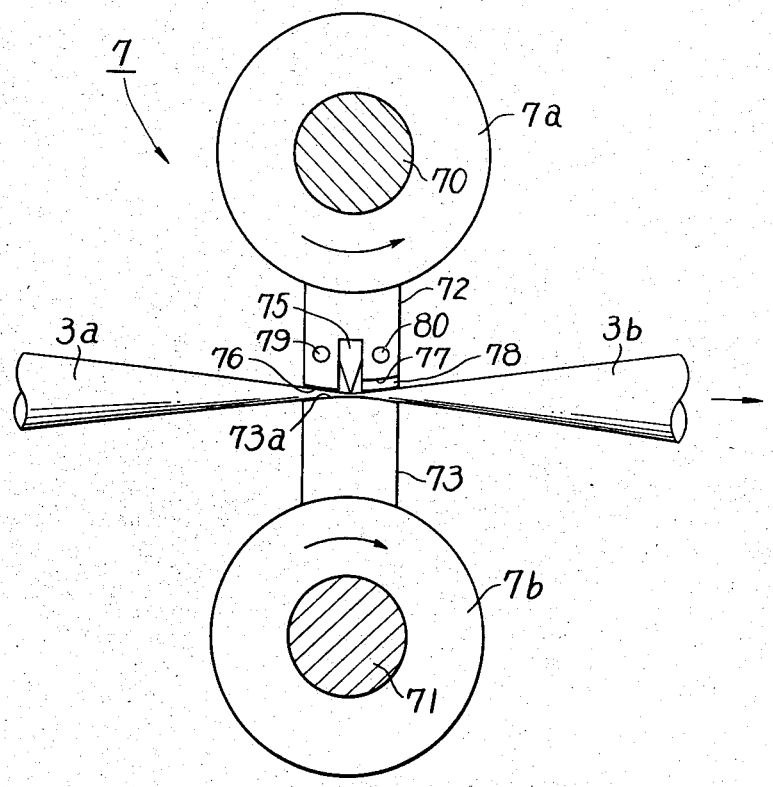
FIG. 3 is a side elevational view showing a film sealing and cutting device in the apparatus.
Figure 4:
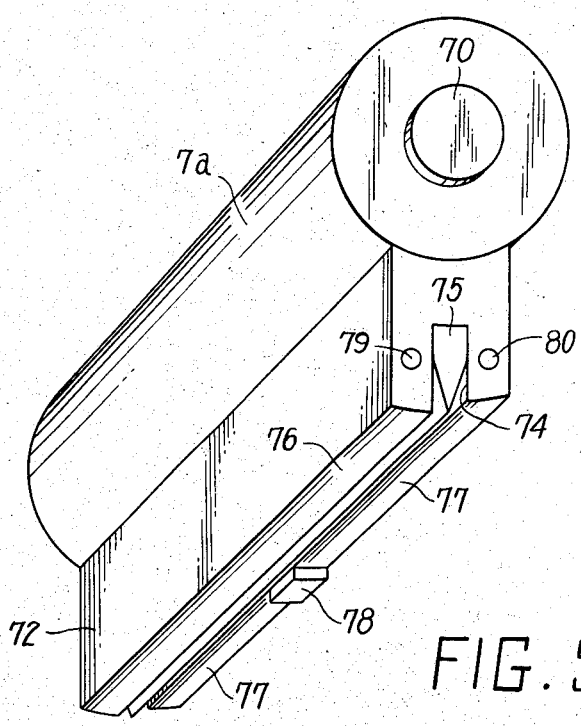
FIG. 4 is a perspective view showing an upper roll of the film sealing and cutting device.

The film sealing and cutting device 7 has a parallel pair of upper and lower rolls 7*a* and 7*b* which rotate around their respective shafts 70 and 71 synchronously with each other as shown in FIG. 3. The upper and lower rolls 7*a*, 7*b* have upper and lower heads 72 and 73, respectively, each of which projects radially outward and extends parallelly to the axis of the roll along its surface. In the projecting outer portion of the head 72, as shown in FIG. 4, is formed a groove 74 extending in its longitudinal direction in which a cutter blade 75 is fixedly inserted.

On the operational upstream side of the groove 74 (on the left side as viewed in FIG. 4) is provided a sealing surface 76, the whole area of which is adapted to contact the tube 3*a* when the device 7 cuts the tube 3*a*. On the operational downstream side of the groove 74 are provided non-sealing surfaces 77, 77 between which a sealing step 78 is formed. The sealing step 78 contacts the tube 3*a* when the tube 3*a* is cut. The sealing surface 76, non-sealing surfaces 77 and the outer surface of step 78 are in the shape of arcs in cross section, and the non-sealing surfaces 77 are nearer to the axis of the upper roll 7*a* than the sealing face 76, while the outer surface of the step 78 and the sealing surface 76 are at the same radial distance from the axis of the roll 7*a*. The cutting edge of the cutter blade 75 is also at the same radial distance from the axis of the roll. Within the head 72 and below the sealing and non-sealing surfaces 76 and 77 are respectively embedded two bar-like heaters 79 and 80, connected to a heating source (not shown), for heating the step 78 and the sealing surface 76.

Figure 5:
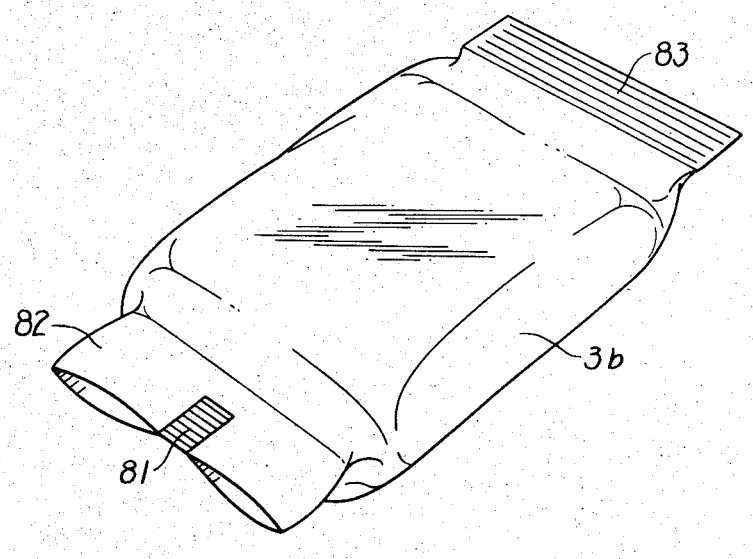
FIG. 5 is a perspective view showing a sealed and cut bag containing one or more articles prior to being processed within a vacuum box.

The projecting outer surface 73*a* of the lower head 73 of the lower roll 7*b* cooperates with the upper head 72 of the upper roll 7*a* so as to hold the tube 3*a* therebetween. When the cutter blade 75 is positioned in the plane passing through the respective axes of the shafts 70 and 71 as shown in FIG. 3, the tube 3*a* is cut transversely by the cutter blade 75 cooperating with the surface 73*a* of the head 73. Before the cutter blade 75 comes to its cutting position for cutting the tube 3*a*, the heated step 78 cooperates with the surface 73*a* of the head 73 to form a sealed part 81 in the central area of the flat upstream open end 82 of the bag 3b as shown in FIG. 5. After the cutter blade 75 cuts the tube 3a, the sealing surface 76 of the head 72 cooperates with the surface 73a of the head 73 to form a flat fully-closed end 83 of the succeeding bag 3b on its downstream side.

The velocity of the rotation of the device 7 is adjusted according to the velocity of travel of the tube 3a, and the rotation of the device 7 is adjusted so as to cut one of the midway portions of the tube 3a between adjoining articles 1, 1 in the tube 3a during one rotation of the rolls 7a, 7b. The bags cut by the device 7 are fed to the downstream end of the second feeding conveyor belt 8 running at a velocity faster than that of the travel of the tube 3a thereby to feed the bags 3b at appropriate space intervals to the vacuum sealing device $M_2$.

Figure 6:
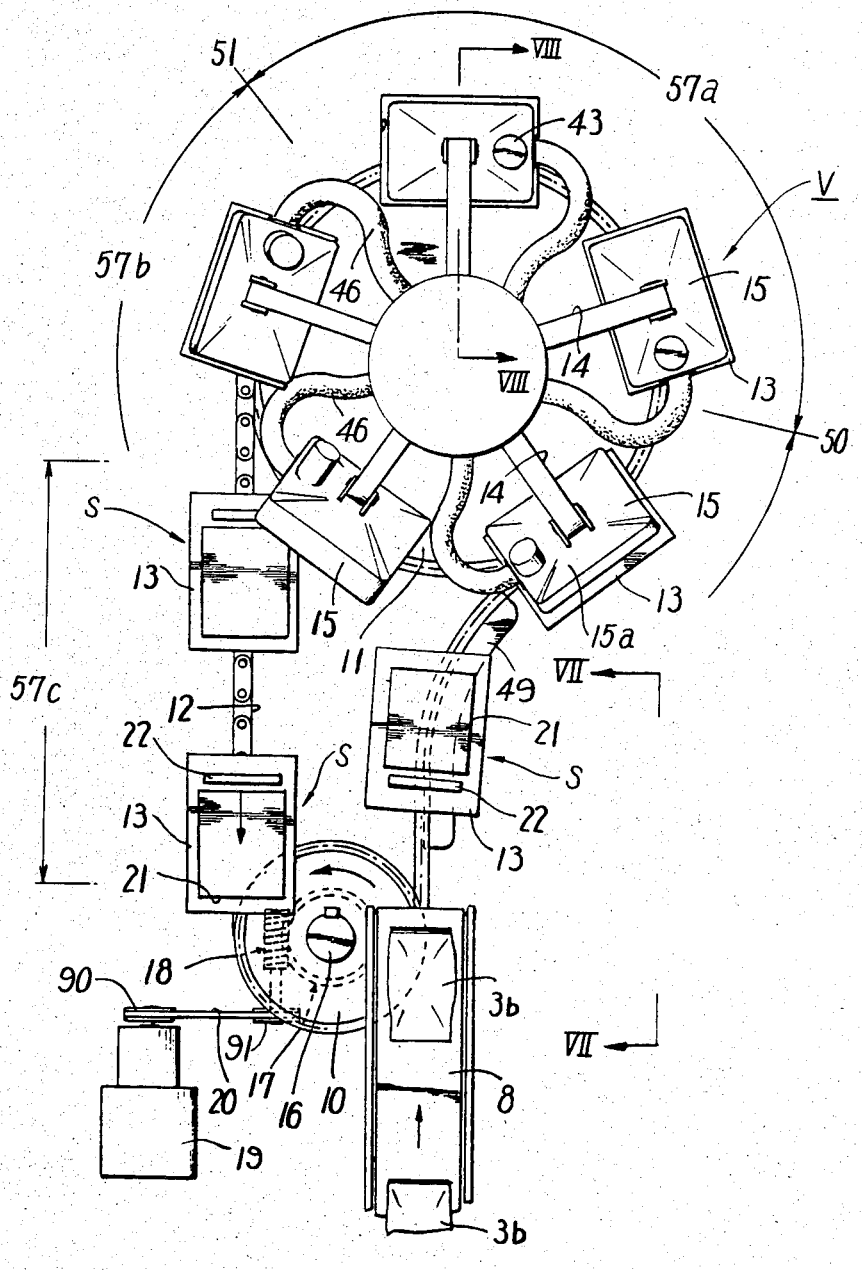
FIG. 6 is a plan view showing a vacuum sealing device having a plurality of vacuum boxes.

The vacuum sealing device $M_2$ has an endless chain 12 moving around a driving sprocket wheel 10 and larger driven sprocket wheel 11 as shown in FIG. 6. The chain 12 is fixedly provided, at equal space intervals, with a plurality of rectangular bag supporting devices S, S, . . . S for supporting respective bags 3b. The driving sprocket 10 is driven by a driving motor 19 via a chain 20 passed around a driving sprocket 90 of the motor 19 and a driven sprocket 91, a worm gear 18 connected to the sprocket 91, a spur gear 17 meshed with the worm gear 18, and a shaft 16 connecting the spur gear 17 with the driving sprocket 10. The downstream end of the second feeding conveyor belt 8 is positioned above a circumferential part of the driving sprocket wheel 10 and the traveling path of the supporting devices S. The traveling path of the chain 12 between the two sprockets 10, 11 on the left side as viewed in FIG. 6 is substantially linear, but that on the right side is reflexively curved by a guide plate 49 of arcuate shape, whereby a longer circumferential part of the driven sprocket 11 is engaged with the chain 12.

Figure 7:
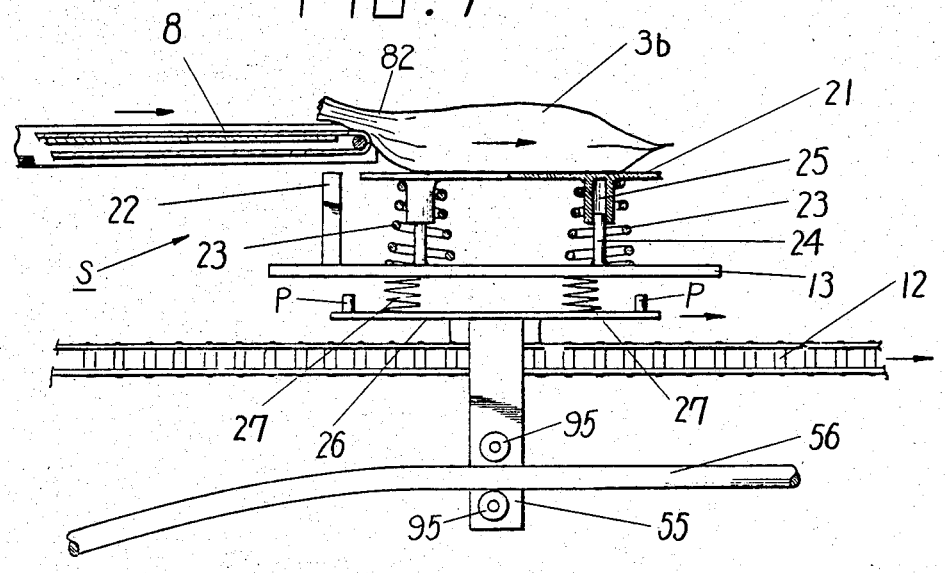
FIG. 7 is an enlarged side elevational view, as viewed in the direction of two arrows VII, VII in FIG. 6, showing a bag supporting device in a state where its supporting plate has just received a bag from a feeding conveyor.

Each of the supporting devices S has a seat plate 26 having a number of projections P, P, . . . P and fixed to the chain 12, a base plate 13 which is larger than the seat plate 26 and is supported elastically on the seat plate 26 by a plurality of compressible coil springs 27, 27, . . . 27, and a supporting platform 21 for elastically receiving thereon one bag 3b fed by the conveyor belt 8 as shown in FIG. 7. The supporting platform 21 is disposed at a height position close to the lower surface of the second feeding conveyor belt 8 to decrease the distance of drop therebetween when the bag 3b is transferred from the belt 8 onto the platform 21. This structure can ensure a smooth transference of the bag from the belt 8 onto the platform 21. Each seat plate 26 is tiltably supported by a hinge 54 on the outer periphery of the driven sprocket 11. On the lower surface of the supporting platform 21 are provided a plurality of bosses 25, 25, . . . 25 into which respective projecting pins 24, 24, . . . 24 fixed to the base plate 13 are slidably inserted. A plurality of compressible coil springs 23, 23, . . . 23 provided so as to surround each of the pins 24 and the bosses 25 elastically support the supporting platform 21 on the base plate 13.

Figure 8:
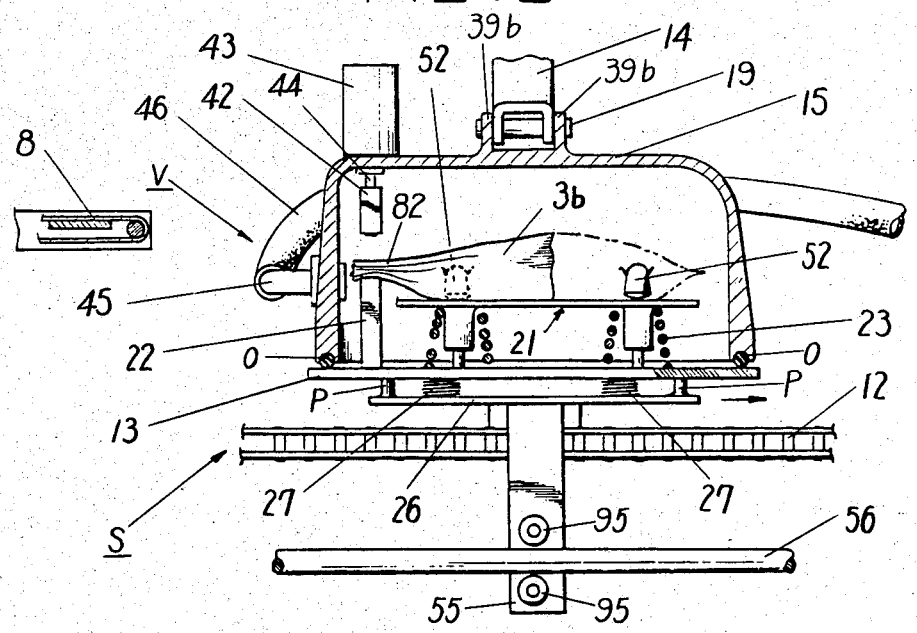
FIG. 8 is an enlarged side elevational view, in vertical section taken along the plane indicated by line VIII—VIII in FIG. 6 as viewed in the arrow direction, showing a state in which a vacuum cover has been placed on the bag supporting device.

To the upper surface of each base plate 13 at a position near its upstream end is fixed a pillow head 22 on which the upstream open end 82 of the bag 3b rests when the bag 3b is fed onto the supporting plate 21 as shown in FIG. 8. The top surface of the pillow head 22 and that of the supporting platform 21 lie in the same horizontal plane, and the coil springs 23 are strong enough to support one bag 3b with no appreciable compression thereof.

Figure 9:
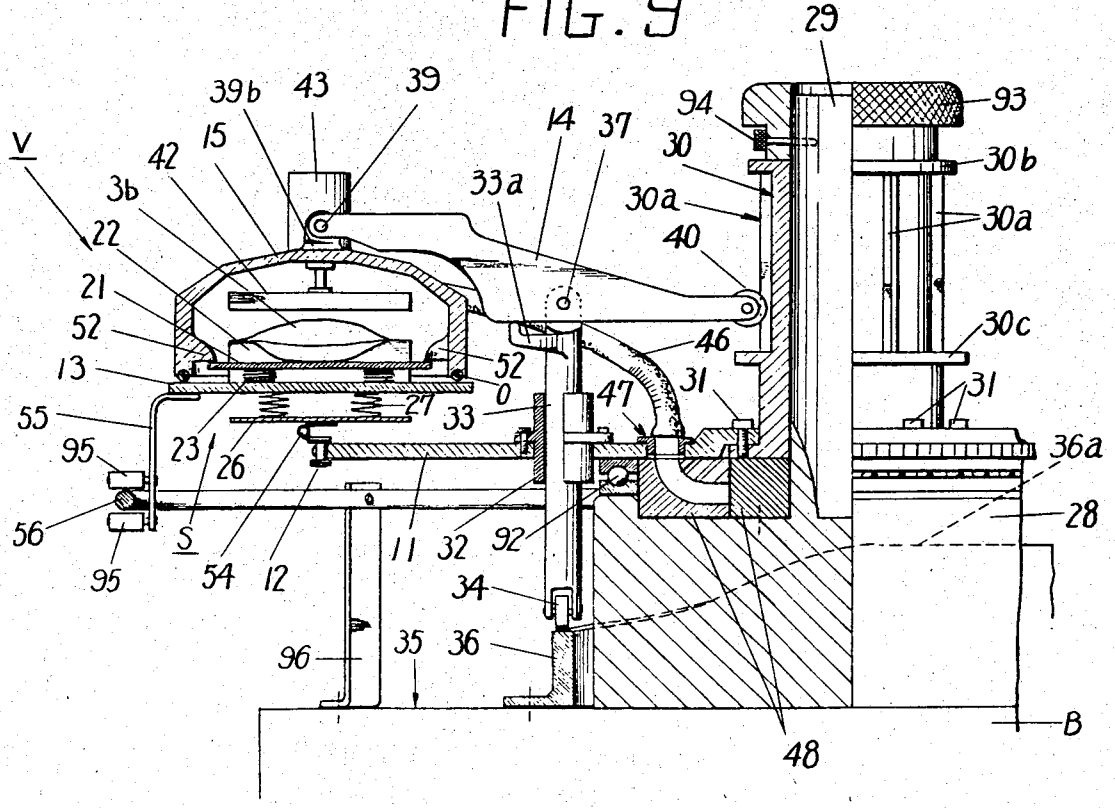
FIG. 9 is an enlarged front elevational view, in partial vertical section, showing the vacuum sealing device.

The driven sprocket wheel 11 is revolvably supported on the stand 28 fixed to a base B via an annular ball bearing 92 as shown in FIG. 9. A pole 29 extends vertically from the upper surface of the stand 28, and around this pole a rotating sleeve 30 is rotatably fitted. The pole 29 has a stop head 93, at its top portion, fixed thereto by a stop pin 94. The stop head 93 prevents the sleeve 30 from moving upward. The rotating sleeve 30 is fixed, at its lower end, to the driven sprocket wheel 11 by a plurality of fastening bolt 31, 31, . . . 31, and a rotary change-over valve 48 is provided below the central part of the driven sprocket 11. On the circumferential surface of the sleeve 30 are provided a plurality of vertical guide rails 30a, 30a, . . . 30a at equal intervals in the circumferential direction, which guide rails 30a extend between upper and lower flanges 30b, 30c. Each of the guide rails 30a is engaged with a respective one of guide wheels 40 rotatably supported at the inner ends of respective supporting levers 14.

Each of the levers 14 is supported at its middle part by a respective vertical supporting rod 33 at its upper end. Each of the rods 33 is slidably guided by a guide sleeve 32 fixed to the sprocket wheel 11. At the upper end of each rod 33 is provided a stop arm 33a for limiting the rocking motion of the supporting lever 14. Each of the rods 33 has a cam follower 34 in the form of a small roller which rolls on the cam surface of an annular cam 36 fixed to the base B coaxially with the stand 28.

The angular portion 57a between a first position 50 and a second position 51 as indicated in FIG. 6 of the cam surface of the annular cam 36 is at a higher position than that of the remaining portion 57b. Accordingly, when the cam follower 34 rolls on the cam surface 36a of the cam 36, the rod 33 moves vertically thereby to raise and lower the pivoted part of the supporting lever 14.

A box-like vacuum cover 15 with an open bottom is pivotably suspended from the outer end of each arm 14 by a pivot pin 39a and two spaced-apart projections 39b, 39b formed on the central part of the upper surface of the ceiling plate 15a of the vacuum cover 15. Each cover 15 and the corresponding bag supporting device S together form a vacuum box V. The bottom of the cover 15 is open, and its lower peripheral surface is provided with an endless seal ring O for sealing the space between the lower peripheral surface of the cover 15 and the upper surface of the base plate 13. On the inner wall surface of the cover 15, at a level intermediate between the ceiling 15a and the bottom, a number of pushing members 52, 52, . . . 52 are formed to push downward against the edge portions of the supporting platform 21 to lower the plate 21, compressing the springs 23, when the cover 15 is placed on the base plate 13 as shown in FIG. 8.

On the ceiling plate 15a of each cover 15 is mounted an air cylinder 43 for actuating a heating bar 42 connected to the cylinder 43 via a piston rod 44 and positioned to confront the pillow head 22 on the base plate 13 when the cover 15 is placed on the bag supporting device S. The heating bar 42 is moved vertically by the air cylinder 43, and presses downward against the open end 82 of the bag 3b resting on the upper surface of the pillow head 22 so as to heat-seal the open end 82. At this time, as the supporting platform 21 is slightly lowered by the pushing members 52, the open end of the bag 3b lies naturally or horizontally on the pillow head 22 thereby being supported steadily for being properly heat-sealed, without formation of wrinkles, by the heating bar 42.

To the outer side of each of the seat plates 26 is fixed a downwardly extending strut 55, whose lower part rotatably supports two rollers 95, 95 spaced apart in the vertical direction so as to loosely hold a guide rail 56 therebetween and roll therealong. The guide rail 56 extends along the traveling path of the chain 12 on its outer side and is supported by a number of vertical posts 96 fixed to the base B. A part of the guide rail 56 corresponding to the linear span 57*c* of the traveling path is at a position slightly lower than that of the remaining part of the rail 56. Accordingly, when each of the bag supporting devices S travels in the span 57C, it tilts outwardly about the hinge 54 to drop the bag 3*b*, which has been sealed in a vacuum, off the supporting platform 21.

A side wall of each cover 15 is provided therethrough with a pipe fitting 45 to which one end of a vacuum flexible pipe 46 is connected, the other end of the pipe 46 being connected to a coupling 47 fixed to a specific part of the sprocket 11 and communicating to one of the rotating passages of the aforementioned rotary valve 48. The inner space of the cover 15 is thus connectable to a vacuum pump (not shown) via the pipe 46 and the valve 48.

The packaging apparatus of the above described construction and organization according to this invention is operated in the following manner.

Each of the bags 3*b* formed by the bag forming device $M_1$ is fed with preset timing onto one of the bag supporting devices S of the vacuum sealing device $M_2$. The traveling speed of the devices S is adjusted, according to the speed of the conveyor belt 8, the intervals between adjoining bags, and the intervals between adjoining bag supporting devices S so that each of bags 3*b* can correctly drop on the supporting platform 21 of one of the bag supporting devices S.

When each device S with the bag 3*b* on its supporting platform 21 passes the first position 50 in its traveling path in the circumferential direction as indicated in FIG. 6, a cover 15 is lowered onto the base plate 13 as a consequence of the cam follower 34 beginning to roll on the lower cam surface. At this time, the pushing members 52 push the bag supporting platform 21 downward with the weight of the cover 15 to lay the open end of the bag 3*b* on the pillow head 22 in a natural manner, and the closed space in the vacuum box V is connected to the vacuum pump via the valve 48 to be evacuated. Furthermore, the springs 27 function to receive the cover 15 elastically on the base plate 13.

When the space in the vacuum box V is evacuated to a specific degree, the air cylinder 43 operates to lower the heating bar 42 to seal the open end of the bag 3*b*. The vacuum sealing operation of each of the vacuum boxes V takes place within the angular travel portion 57*a* (in FIG. 6). After the vacuum sealing operation, air is fed into the vacuum box V whereby the wall of the bag 3*b* is caused to stick onto one or more articles therein by the pressure of the air. When each supporting device S passes the end position 51 of the travel portion 57*a*, the cover 15 is raised because the cam follower 34 rolls on the higher surface of the cam 36. At the same time, the supporting platform 21 is raised to its original position by the repulsive force of the springs 23.

As the base plate 13 of the bag supporting device S remains horizontal, being supported by the guide rail 56 via the strut 55 and rollers 95, the device S travels along the greater part of its traveling path. However, when the supporting device S passes through the linear span 57C of the traveling path, it tilts outwardly about the hinge 54 to cause the bag 3*b* to slide outwardly off the supporting platform 21 as the rollers 95 of the strut 55 roll on a lowered part of the guide rail 56 to lower the outer end of the base plate 13 via the strut 55.

Thus, each of the bag supporting devices S receives continuously, at the upstream end of the conveyor belt 8, one of the bags 3*b* fed with preset timing by the conveyor belt 8, and each of the bags is sealed in a corresponding one of the vacuum boxes V. When the bag 3*b* on the conveyor belt 8 drops onto the supporting platform 21, the open end 82 of the bag 3*b* must be laid correctly on the pillow head 22 to seal the end 82 reliably by means of the heating bar 42. Therefore, in the present invention, each of the supporting platforms 21 is disposed at a height position close to the lower surface of the belt 8 to decrease the drop distance between the upper surface of the belt 8 and the upper surface of the supporting platform. Furthermore, after the bag 3*b* has been placed on the supporting platform 21, the platform 21 is lowered by the weight of the cover 15 via the pushing members 52 to lay the open end of the bag 3*b* horizontally on the pillow head 22. Thus, a reliable and positive sealing of the open end 82 is carried out without wrinkles on the end 82 by the heating bar 42 cooperating with the pillow head 22.

In the above embodiment of the invention, the supporting platform 21 is adapted to be lowered by the weight of the vacuum cover 15. However, the force of each of the coil springs 23 for supporting the supporting platform 21 may be adjusted in such a manner that the coil springs 23 can support the platform 21 at a suitable unloaded height but can contract with the weight of the bag 3*b* when it is placed on the platform 21.

Figure 10:
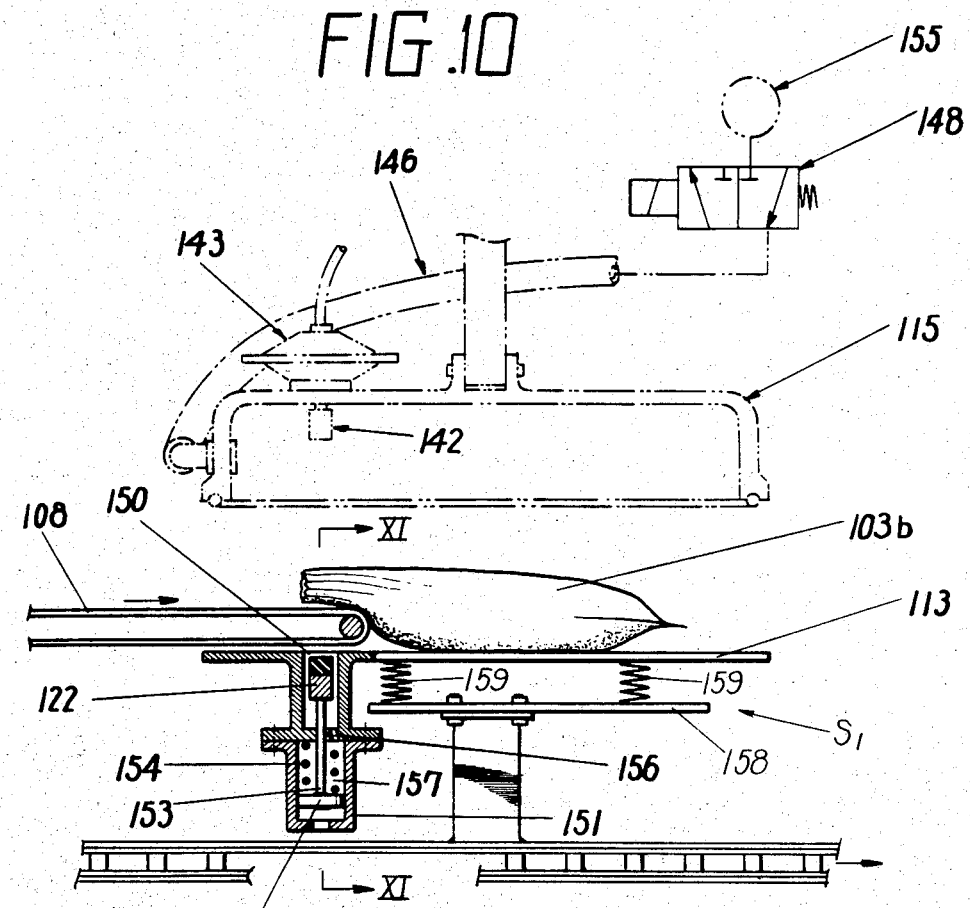
FIG. 10 is an enlarged side elevational view, in partial vertical section, showing another example of the bag supporting device.
Figure 11:
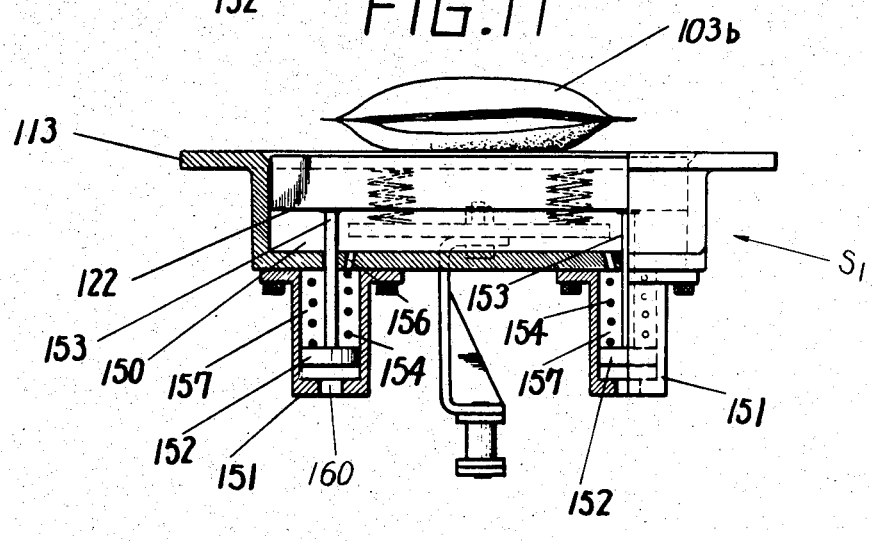
FIG. 11 is an enlarged front elevational view in partial vertical section taken along the plane indicated by line XI—XI in FIG. 10 as viewed in the arrow direction.

FIGS. 10 and 11 show another embodiment of the invention wherein each bag supporting device $S_1$ has a seat plate 158 and a base plate 113 supported by the seat plate 158 via a number of compressive coil springs 159, 159, . . . 159. At the upstream end portion of the base plate 113 is formed a receiving box 150 extending transversely relative to the traveling path of the device $S_1$. In this receiving box 150 a pillow head 122 is so provided as to be capable of moving vertically.

To the two ends of the lower surface of the box 150 are fixed two respective operating cylinders 151, 151 for moving the pillow head 122 vertically. In each of the cylinders 151 is accommodated a piston 152 continually urged downward by a spring 154. Each piston 152 is connected to the pillow head 122 via a piston rod 153.

In the bottom wall of each of the cylinders 151 is formed a through hole 160, and in the bottom wall of the box 150 are provided two through holes 156, 156 respectively communicating the spaces 157 within the cylinders 151 with the interior space of the box 150.

A vacuum cover 115 for operating similarly as the vacuum cover 15 of the preceding example has a diaphragm device 143 for operating a heating bar 142 on its ceiling plate, and a flexible pipe 146 connected at its one end to a fitting installed in a side wall of the cover 115 is connected at its other end to a changeover valve 148 which is connected to a vacuum pump 155.

After a bag 103*b* has been fed onto the base plate 113 by a conveyor belt 108, the cover 115 is placed on the plate 113. Then, the air pressure in the cover 115 is decreased by the vacuum pump 155. When space within the cover 115 has been evacuated, the air pressure in the spaces 157 of the cylinders 151 decreases to cause the pistons 152 to rise thereby to support the open end of the bag 103*b*. After the open end thereof has been sealed by the heating bar 142, the valve 148 is operated so as to feed air into the cover 115. At this time, the pillow head 122 is retracted downward by the repulsive force of the springs 154 in the cylinders 151.

In this embodiment of the invention, there is no member corresponding to the supporting platform 21 of the preceding embodiment as shown in FIGS. 1 through 9, and the bag 103*b* is fed directly onto the base plate 113. Accordingly, each bag supporting device $S_1$ can receive a bag steadily. Furthermore, the pillow head 122 is adapted to be automatically moved by the difference of pressures in the cylinder 151. However, two other cylinders operated by a compressor (not shown) may be substituted for the cylinders 151.

Figure 12:
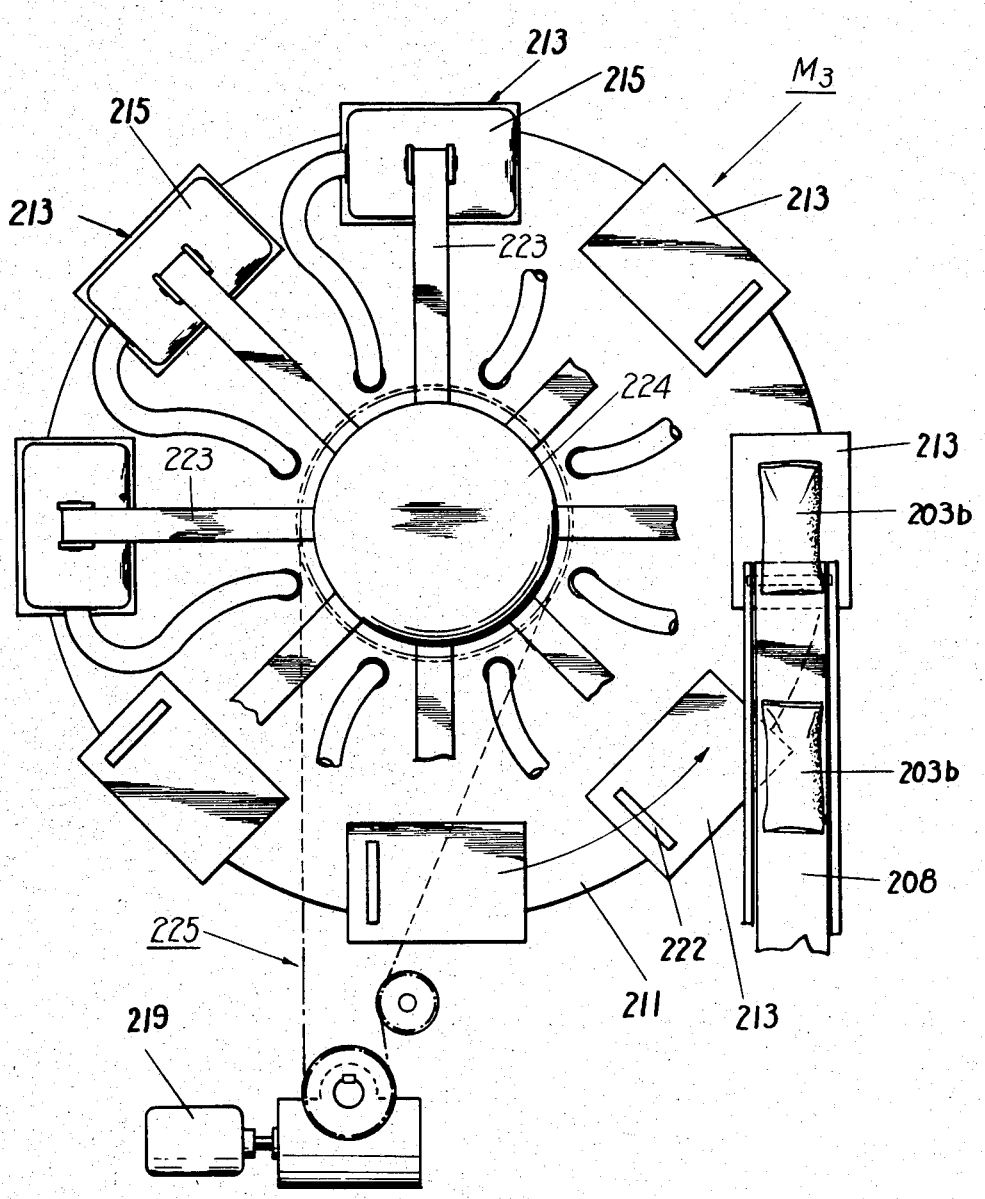
FIG. 12 is a plan view showing another example of the vacuum sealing device.

FIG. 12 shows another example of a vacuum sealing device $M_3$, which has a large turn table 211, on the periphery of which a plurality of bag supporting devices 213, 213, . . . 213, each having a pillow head 222, are directly mounted. A plurality of levers 223, 223, . . . 223 extend radially outward from a central pole 224 and support at their outer ends respective vacuum covers 215 in suspended state. The turn table 211 is adapted to be rotated by a motor 219 via a driving force transmitting mechanism 225. A conveyor belt 208 for feeding bags 203*b* is positioned along a tangent line of the turn table 211 to cause the bags 203*b* to be fed onto their respective supporting devices 213 in a regular manner.

Figure 13:
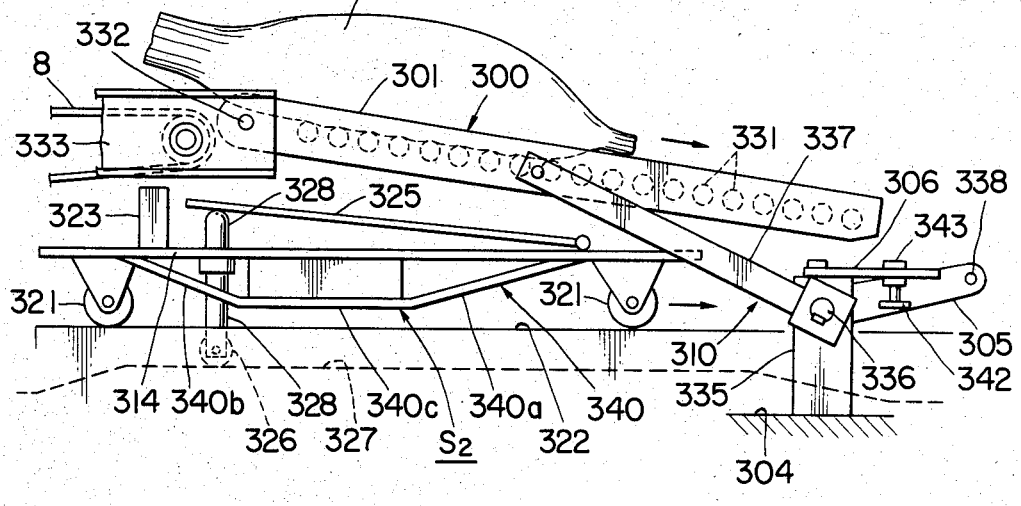
FIG. 13 is a side elevational view showing another example of the bag supporting device which cooperates with a swingable guide body provided at the front end of a feeding conveyor.
Figure 14:
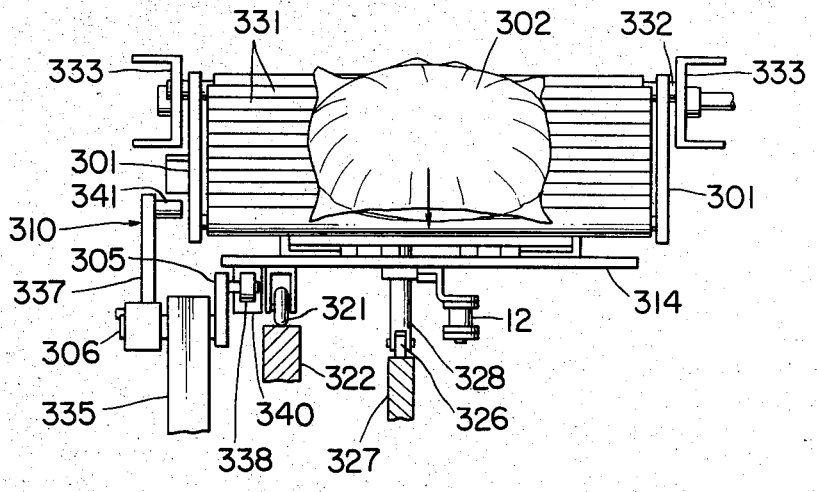
FIG. 14 is a front elevational view of the example shown in FIG. 13.

FIGS. 13 to 16 show still another embodiment of the invention wherein a swingable guide body 300 is pivotably provided at the front end of the second feeding conveyor belt 8. The swingable guide body 300 has a pair of side plates 301, 301 spaced from each other in the transverse direction of the conveyor belt 8 and a plurality of rollers 331, 331, . . . 331 which are rotatably disposed between the side plates 301, 301 in order to smoothly guide a bag 302 (FIGS. 13 and 14). Rear ends of the side plates 301, 301 are pivotably fitted to the front ends of side frames 333, 333 via a pin 332, respectively.

The endless chain 12 supports a plurality of supporting devices $S_2$, one of which is shown in the drawings. Each supporting device $S_2$ has a base plate 314 guided horizontally by a rail 322 via a pair of guide rollers 321, 321 disposed apart from each other in the moving direction of the supporting device $S_2$. On the base plate 314 is mounted a supporting platform 325 which is hinged, at its front end, on the base plate 314. The rear side of the supporting platform 325 is supported by a rod 328 so as to move vertically. The rod 328 has, at its lower end, a cam follower 326 rotating along a cam surface 327 and is held slidably by the base plate 314. The upper end of the rod 328 engages with the lower surface of the supporting platform 325.

Along the rear side of the supporting platform 325 is provided a pillow head 323 fixed to the base plate 314. On the outer side of the lower surface of the base plate 314 is provided a cam 340 which has two inclined portions 340*a*, 340*b* at its front and rear sides and a horizontal portion 340*c* at its center portion.

The side plate 301 on the outer side of the guide body 300 is supported swingably by an arm 337 forming a part of a crank arm 310 at its center portion. The arm 337 is swingably held by a support 335 fixed to a fixed member 304 through a rotary pin 336. The rotary pin 336 holds the arm 337 and an arm 305 at its opposite ends, respectively. To the support 335 is fixed a supporting plate 306 which supports a screw 343. The screw 343 engages with a stopper 342 to limit the upward movement of the arm 305. At the free end of the arm 305 is fitted a cam follower 338 cooperating with the cam 340 on the base plate 314.

Figure 16:
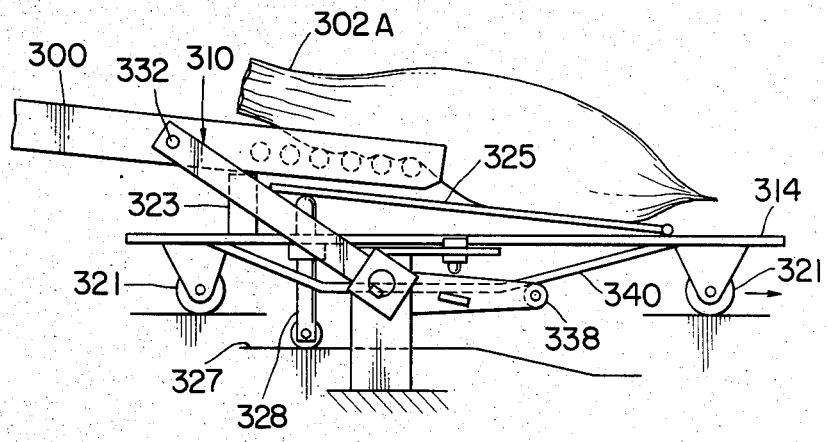
FIG. 16 is a side elevational view showing a state wherein the bag has been just transferred from the swingable guide body onto the bag supporting device.
Figure 17:
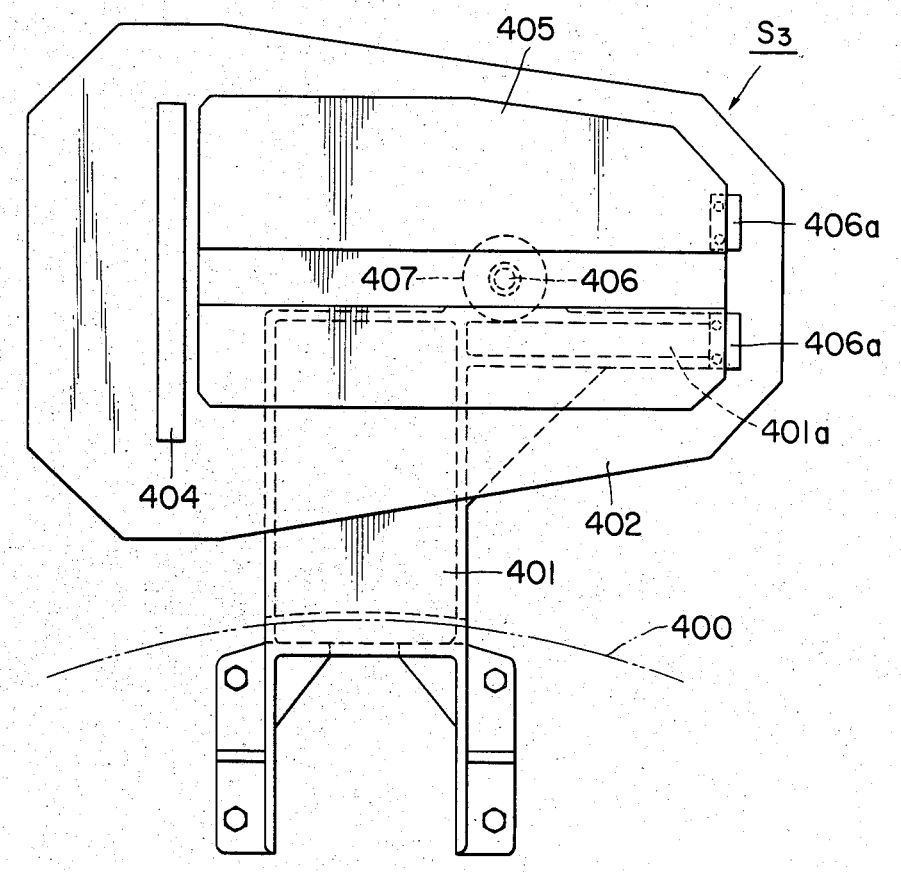
FIG. 17 is a plan view showing another example of the bag supporting device.
Figure 18:
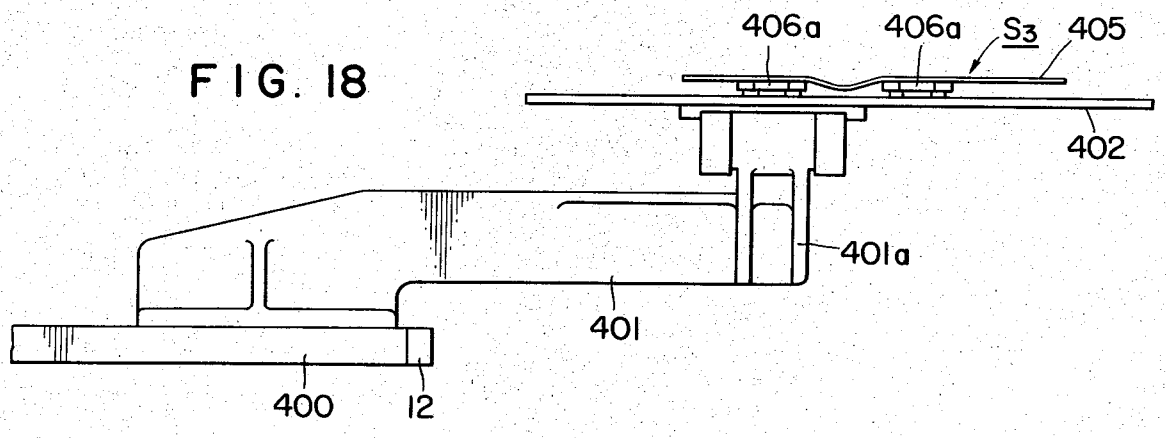
FIG. 18 is a front elevational view showing the example shown in FIG. 17.

This device is suitable for relatively heavy bags. In the case of heavy bags, it is especially difficult to move each heavy bag smoothly onto each supporting device $S_2$ from the second feeding conveyor belt 8. In this embodiment, the guide body 300 guides each bag downward and the supporting platform 325 receives the bag in an inclined state as shown in FIG. 16. That is, the guide body 300 is normally at an inclined position with the stopper 342 engaging with the screw 343. The cam surface 327 is at a raised position under the guide body 300. The rear end of the supporting platform 325 is raised by the rod 328 so that the platform 325 is inclined along the guide body 300 when the bag rides on the platform 325.

When the platform 325 passes the front end of the guide body 300, the cam 340 contacts the cam follower 338 thereby to swing the crank arm 310 in the clockwise direction as viewed in FIG. 16. As a result, the front end of the guide body 300 is raised so as to permit the pillow head to pass the front end thereof without collision therebetween.

After the completion of the transference of the bag, the platform 325 is lowered to a horizontal position because the rod 328 is lowered along a lowered portion of the cam surface 327. With this state, the open end 302A of the bag is laid on the pillow head 323 in its horizontal state.

FIGS. 17 to 20 show another embodiment of this invention in which each supporting device $S_3$ is disposed, via a support arm 401, on the periphery of a sprocket (turn table) 400 rotated by the chain 12. The support arm 401 has, at its distal end, a portion 401*a* extending in the moving direction of the supporting device $S_3$. To the rear end of the portion 401*a* is pivotally connected a swingable base plate 402 via a pivot pin 403. The base plate 402 has a pillow head 404 at its front portion and holds a supporting platform 405 which is hinged at 406*a*. The platform 405 is smaller in size than the base plate 402 and is supported, at its center portion, by a support pin 406 which is slidably held by a guide sleeve 406 fixed to the lower surface of the base plate 402. At the lower end of the support pin 406 is rotatably held a roller 408 which is guided by a guide plate 409. The guide plate 409 is slantingly fixed to the portion 401*a* of the support arm 401 so that the support pin 406 can keep the platform 405 horizontal even when the base plate 402 is inclined downwardly.

Figure 19:
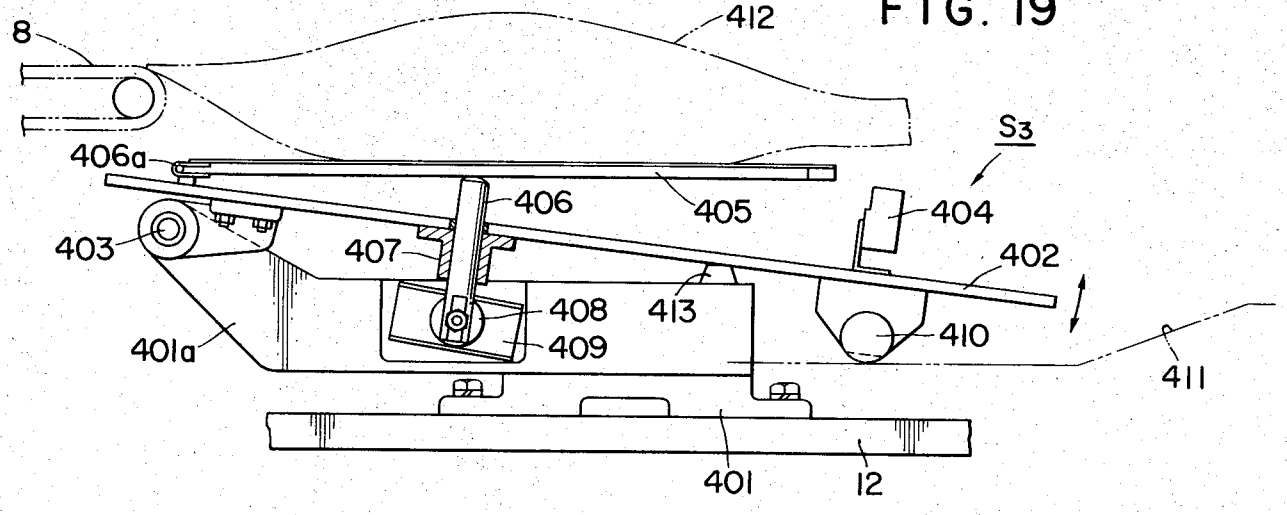
FIG. 19 is a side elevational view showing a state wherein the bag has been just transferred from the feeding conveyor onto the bag supporting device.
Figure 20:
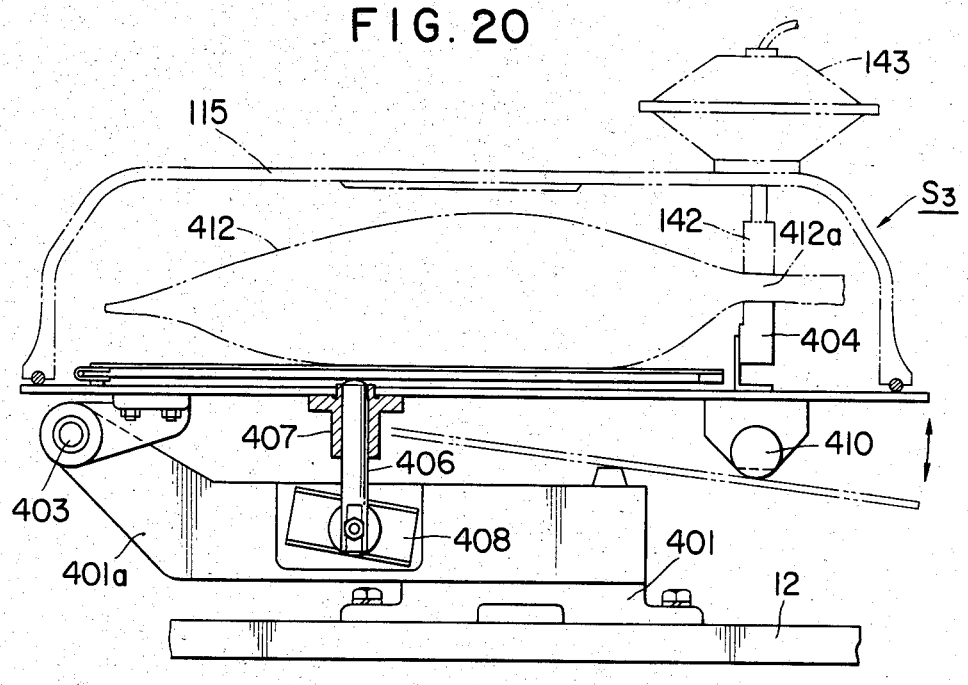
FIG. 20 is a side elevational view showing a state wherein the bag is sealed in the vacuum box.

At the front portion of the base plate 402 is provided a cam follower 410 which rotates on a cam surface 411. A portion of the cam surface 411 at a position where a bag 412 is transferred from the second feeding conveyor 8 onto the platform 405 is at a lower height position than that of other portions thereof to cause the base plate 402 to slant downwardly whereby the pillow head 404 can be prevented from colliding with the lower surface of the conveyor 8, as shown in FIG. 19, when each supporting device $S_3$ reaches a position where it receives the bag 412. The base plate 402 is adapted to abut against a stopper 413 fixed to the upper surface of the portion 401*a* when it is inclined downwardly.

After the supporting device $S_3$ has received the bag 412, the front portion of the base plate 402 is raised along the raised portion of the cam surface 411 until it takes a horizontal posture. Thereafter, the cover 115 shown in FIG. 10 is lowered on the base plate 402 to form a vacuum box in which the bag 412 is accommodated. Then the open end of the bag 412 is sealed between the heating bar 142 and the pillow head 404.

Figure 15:
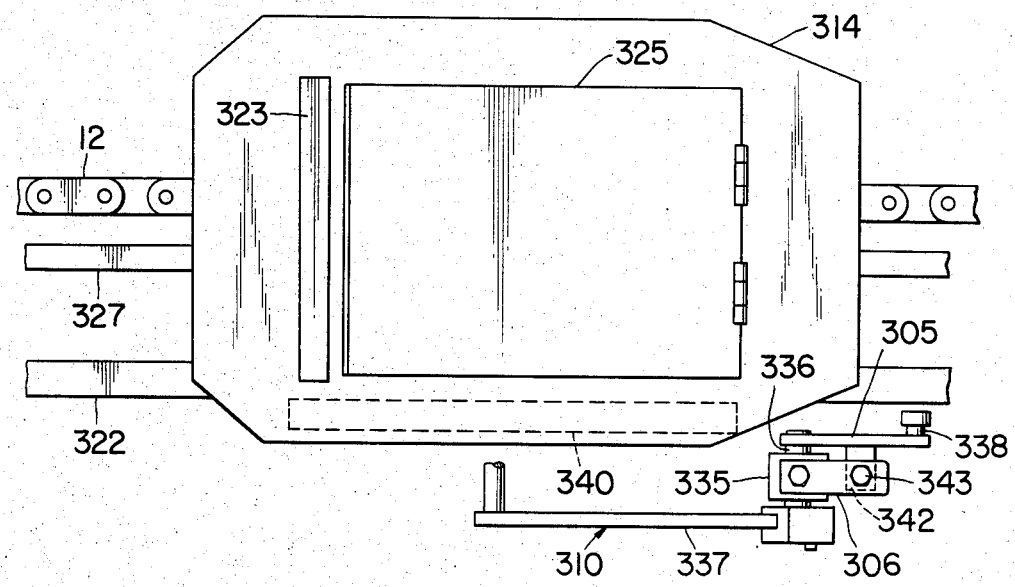
FIG. 15 is a plan view showing the bag supporting device shown in FIG. 13.
Figure 22:
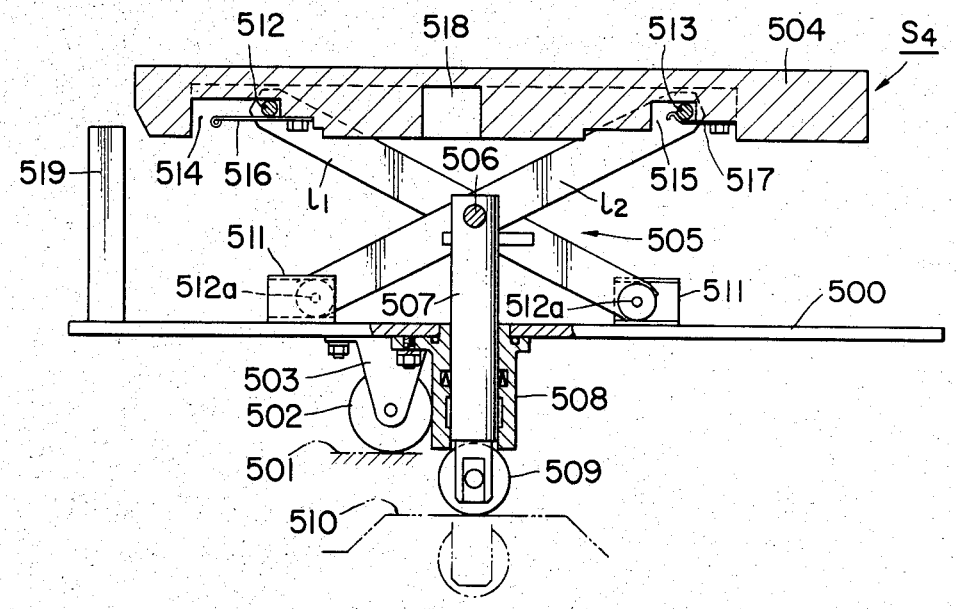
FIG. 22 is a side elevational view of the example shown in FIG. 21.
Figure 21:
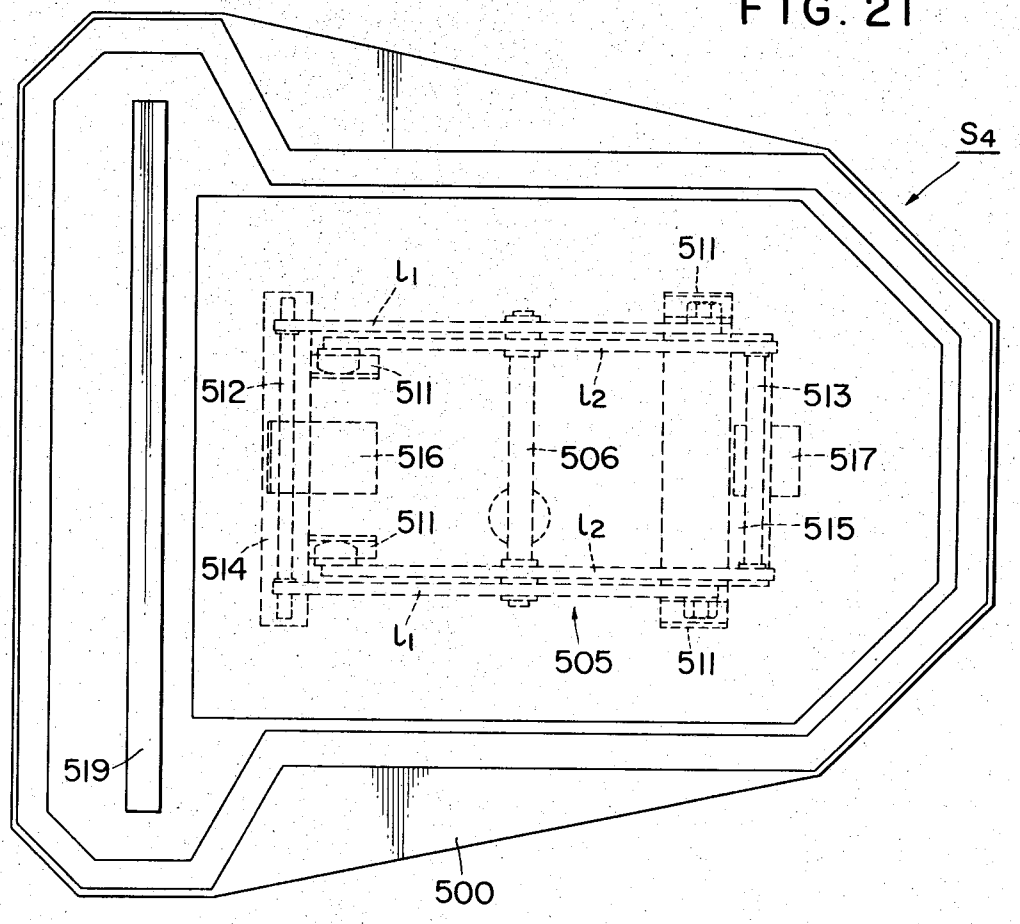
FIG. 21 is a plan view showing another example of the bag supporting device.

FIGS. 21 and 22 show another example of this invention wherein a supporting device $S_4$ is supported by a driving chain (not shown) in the same manner as shown in FIGS. 14 and 15. The supporting device $S_4$ has a base plate 500 which moves horizontally along a guide rail 501 on which a roller 502 rotates. The roller 502 is supported by the lower surface of the base plate 500 having a pillow head 519 thereon through a support arm 503. A supporting platform 504 is so supported on the base plate 500 as to move vertically via a link mechanism 505. This link mechanism 505 comprises a pair of first links $l_1$, $l_1$ and a pair of second links $l_2$, $l_2$. The adjoining links $l_1$, $l_2$ cross each other. Two crossing portions of the links $l_1$, $l_2$ are connected to each other by a connecting rod 506 which is supported by the upper portion of a support pin 507. The support pin 507 is held slidably by a guide sleeve 508 fixed to the base plate 500 and is moved vertically when a cam follower 509 rotatably held on the lower end of the support pin 507 moves along a cam surface 510. The lower ends of the links $l_1$, $l_2$ are slidably held by four guide plates 511 in which four rollers 512*a* provided at the lower ends of the links $l_1$, $l_2$ are rotatably accommodated, respectively.

Between the upper ends of the links $l_1$, $l_1$ is provided a connecting bar 512 which is accommodated in a recess 514 formed on the lower surface of the platform 504 while between the upper ends of the links $l_2$, $l_2$ is provided a connecting bar 513 which is slidably accommodated in a recess 515 formed on the lower surface thereof. The bars 512, 513 are supported by two leaf springs 516, 517, respectively. In addition, on the lower surface of the platform 504 is provided a recess 518 for accommodating the connecting rod 506 when the platform 504 is lowered onto the base plate 500.

The platform 504 receives a bag in a raised position as shown in FIG. 22 and is lowered onto the base plate 500 so that the bag is sealed with the open end of the bag lying horizontally on the pillow head 519.

In these embodiments shown in FIGS. 13 to 22, as the platforms 325, 405, 504 are tightly supported by the base plates 314, 402, 500 without using springs 23, 159 as described in the former two embodiments, a force for raising the vacuum cover 115 is not exerted on the cover 115. Accordingly, the cover 115 can contact the surface of each of base plates 314, 402, 500 air-tightly at an instant when the cover 115 is lowered onto each base plate.

What we claim is:

1. An automatic packaging apparatus comprising:

a bag forming device for automatically forming bags each containing at least one article; and a vacuum sealing device for sealing open ends of the bags in a vacuum;

said bag forming device further comprising:

a tubular film forming device in the shape of a tube for continuously forming an elongated sheet of film into a tube of the film and wrapping the articles fed into the tubular film forming device in a line;

a film sealing and cutting device for cutting the tube of film at preset space intervals to form each of the bags, one end of which is completely sealed and the other end of which is partly sealed; and a feeding device for feeding the bags formed by the film sealing and cutting device to the vaccum sealing device at a faster speed than that of the travel of the tube, the feeding device having, at its front end, a swingable guide body by which each bag is guided to the vacuum sealing device, the swingable guide body being supported by an arm whose swinging motion causes the swingable guide body to swing about the front end of the feeding device;

said vacuum sealing device further comprising:

at least one bag supporting device, revolving synchronously with the feeding device so that each bag supporting device can receive a respective one bag fed by the feeding device along a traveling path and having a pillow head for resting thereon the open end of said bag fed onto the bag supporting device, each bag supporting device having a plate-like supporting member on which the bag is laid and a cam surface cooperating with a cam follower provided on the arm for swinging the guide body, the plate-like supporting member being held swingably on a base plate to which the pillow head is fixed so as to be moved vertically at its end on the side of the pillow by a support member which is moved vertically by a cam mechanism during the travel of the bag supporting device, the plate-like supporting member being raised at its end on the side of the pillow so as to be at a height position close to the lower surface of the guide body to decrease the distance of drop between the feeding device and the plate-like supporting member when the bag is transferred from the guide body onto the plate-like supporting member, the plate-like supporting member being lowered to a horizontal position on the base plate to cause the open end of the bag to lie horizontally on the pillow head when the open end of the bag is sealed, the guide body being swung upwardly to permit the pillow head to pass the front end of the guide body when the cam surface of the bag supporting device operates the cam follower of the arm for swinging the guide body;

at least one vacuum cover, cooperating with each bag supporting device to form a vacuum box in which the open end of the each bag is sealed under a vacuum and revolving synchronously with said bag supporting device while moving vertically to open and close said vacuum box, said vacuum cover having a heating member for sealing the open end of the each bag; and a device for evacuating the inner space of the vacuum box.

2. An automatic packaging apparatus comprising:

a bag forming device for automatically forming bags each containing at least one article; and a vacuum sealing device for sealing open ends of the bags in a vacuum;

said bag forming device further comprising:

a tubular film forming device in the shape of a tube for continuously forming an elongated sheet of film into a tube of the film and wrapping the articles fed into the tubular film forming device in a line;

a film sealing and cutting device for cutting the tube of film at preset space intervals to form each of the bags, one end of which is completely sealed and the other end of which is partly sealed; and a feeding device for feeding the bags formed by the film sealing and cutting device to the vacuum sealing device at a faster speed than that of the travel of the tube;

said vacuum sealing device further comprising:

at least one bag supporting device revolving synchronously with the feeding device so that each bag supporting device can receive a respective one bag fed by the feeding device along a traveling path, the bag supporting device having a support frame member fixed to a rotary member, a base plate pivotally connected to one end of the support frame member so as to be swingable in the moving direction of the bag supporting device, a support platform mounted on said base plate on which the bag is laid, and which is kept horizontal over the base plate at a height position close to the lower surface of the feeding device to decrease the distance of drop between the feeding device and the support platform, a pillow head provided on the side opposite to the pivotally connected portion of the base plate 402 for resting thereon the open end of the bag fed onto the support platform, cam means provided on the same side as that of the pillow head with respect to the base plate and cooperating with a cam surface formed along a travel path of the bag supporting device in order to swing the base plate about the pivotally connected portion, the cam surface being formed in a low height position at a position where the bag is transferred from the feeding device onto the supporting platform to cause the base plate to slant downwardly so that the pillow head can be prevented from colliding with the lower surface of the feeding device and being formed in a high height position at other positions so that the base plate takes a raised posture in a state wherein the pillow head is projected over the supporting platform to rest the open end of the bag thereon horizontally, and support means for keeping the support platform horizontal with respect to the support frame member;

at least one vacuum cover, cooperating with each bag supporting device to form a vacuum box in which the open end of the each bag is sealed under a vacuum and revolving synchronously with said bag supporting device while moving vertically to open and close said vacuum box, said vacuum cover having a heating member for sealing the open end of each bag; and a device for evacuating the inner space of the vacuum box.

3. An automatic packaging apparatus according to claim 2, wherein the support means for keeping the support platform horizontal, has a support pin extending through the swingable base plate, the upper end of which contacts the lower surface of the supporting platform and the lower end of which holds a roller which is guided by a guide plate fixed to the support frame member whereby the support pin can permit the base plate to swing while keeping the support platform horizontal.

4. An automatic packaging apparatus according to claim 2, wherein the rotary member is a sprocket on the periphery of which the support frame member in the shape of an arm is formed, the distal end of the arm supporting the base plate.

5. An automatic packaging apparatus comprising:

a bag forming device for automatically forming bags each containing at least one article; and a vacuum sealing device for sealing open ends of the bags in a vacuum;

said bag forming device further comprising:

a tubular film forming device in the shape of a tube for continuously forming an elongated sheet of film into a tube of the film and wrapping the articles fed into the tubular film forming device in a line;

a film sealing and cutting device for cutting the tube of film at preset space intervals to form each of the bags, one end of which is completely sealed and the other end of which is partly sealed; and a feeding device for feeding the bags formed by the film sealing and cutting device to the vacuum sealing device at a faster speed than that of the travel of the tube;

said vacuum sealing device further comprising:

at least one bag supporting device revolving synchronously with the feeding device so that each bag supporting device can receive a respective one bag fed by the feeding device along a traveling path, the bag supporting device having a base plate moving horizontally on a guide rail formed along a traveling paith of the bag supporting device, the base plate being supported by a guide roller rotating on the guide rail, a pillow head fixed to one end of the base plate to rest thereon the open end of the bag, a supporting platform movable vertically while keeping its horizontal posture, a cross link mechanism capable of expansion and contraction for supporting the supporting platform on the base plate so as to be movable vertically, and a support pin extending slidably vertically through the base plate for expanding and contracting the cross link mechanism, the upper end of the support pin being connected to the cross link mechanism, the lower end of the support pin having a cam follower which rotates on a cam surface formed along the travel path of the bag supporting device, the cam surface being so formed that the supporting platform is raised to a high position close to the lower surface of the feeding device when the bag is transferred from the feeding device thereonto and that the supporting platform is lowered to a low position where the open end of the bag is laid on the pillow head horizontally when the open end thereof is sealed;

at least one vacuum cover, cooperating with each bag supporting device to form a vacuum box in which the open end of each bag is sealed under a vacuum and revolving synchronously with said bag supporting device while moving vertically to open and close said vacuum box, said vacuum cover having a heating member for sealing the open end of each bag; and a device for evacuating the inner space of the vacuum box.

6. An automatic packaging apparatus comprising:

a bag forming device for automatically forming bags each containing at least one article; and a vacuum sealing device for sealing open ends of the bags in a vacuum;

said bag forming device further comprising:

a tubular film forming device in the shape of a tube for continuously forming an elongated sheet of film into a tube of the film and wrapping the articles fed into the tubular film forming device in a line;

a film sealing and cutting device for cutting the tube of film at preset space intervals to form each of the bags, one end of which is completely sealed and the other end of which is partly sealed; and a feeding device for feeding the bags formed by the film sealing and cutting device to the vacuum sealing device at a faster speed than that of the travel of the tube, the feeding device having, at its front end, a swingable guide body by which each bag is guided to the vacuum sealing device, the swingable guide body being supported by an arm disposed to a fixed member of the apparatus whose swinging motion causes the swingable guide body to swing about the front end of the feeding device;

said vacuum sealing device further comprising:

at least one bag supporting device, revolving synchronously with the feeding device so that each bag supporting device can receive a respective one bag fed by the feeding device along a traveling path, the bag supporting device having a pillow head for resting thereon the open end of said bag fed onto the bag supporting device, a plate-like supporting member on which the bag is laid and a cam surface cooperating with a cam follower provided on the arm for swinging the guide body, the plate-like supporting member being held swingably on a base plate to which the pillow head is fixed so as to be moved vertically at its end on the side of the pillow by a support member which is moved vertically by a cam mechanism during the travel of the bag supporting device, the plate-like supporting member being raised at its end on the side of the pillow so as to be at a height position close to the lower surface of the guide body to decrease the distance of drop between the feeding device and the plate-like supporting member when the bag is transferred from the guide body onto the plate-like supporting member, the plate-like supporting member being lowered to a horizontal position on the base plate to cause the open end of the bag to lie horizontally on the pillow head when the open end of the bag is sealed, the guide body being swung upwardly to permit the pillow head to pass the front end of the guide body when the cam surface of the bag supporting device operates the cam follower of the arm for swinging the guide body;

at least one vacuum cover, cooperating with each bag supporting device to form a vacuum box in which the open end of the each bag is sealed under a vacuum and revolving synchronously with said bag supporting device while moving vertically to open and close said vacuum box, said vacuum cover having a heating member for sealing the open end of the each bag; and a device for evacuating the inner space of the vacuum box.

7. An automatic packaging apparatus according to claim 6 wherein the aim for swinging the guide body is in the shape of a crank, one end of which supports the guide body pivotably, the other end of which supports the cam follower, and the center portion of which is pivotably supported by a support provided on the fixed member along a travel path of the bag supporting device, the cam surface for cooperating with the cam follower being formed under the base plate, the cam surface having two inclined portions at its front and rear ends and a horizontal portion at its center portion.

8. An automatic packaging apparatus according to claim 6 wherein the support member is a rod which is provided slidably through the base plate, the upper end of the rod contacting the plate-like support member while the lower end thereof has a cam follower rolling on a cam surface provided along the travel path of the bag supporting device.

9. An automatic packing apparatus comprising;

a bag forming device for automatically forming bags each containing at least one article; and a vacuum sealing device for sealing open ends of the bags in a vacuum;

said bag forming device further comprising:

a tubular film forming device in the shape of a tube for continuously forming an elongated sheet of film into a tube of the film and wrapping the articles fed into the tubular film forming device in a line;

a film sealing and cutting device for cutting the tube of film at preset space intervals to form each of the bags, one end of which is completely sealed and the other end of which is partly sealed; and a feeding device for feeding the bags formed by the film sealing and cutting device to the vacuum sealing device at a faster speed than that of the travel of the tube;

said vacuum sealing device further comprising:

at least one bag supporting device, revolving synchronously with the feeding device so that each bag supporting device can receive a respective one bag fed by the feeding device along a traveling path, the bag supporting device having a base plate which is provided on travel means for transferring the bag supporting devide, a pillow head fixed to the base plate on one side thereof for resting thereon the open end of the bag and a plate-like supporting member supported by at least one elastic member over the base plate, the upper surface of the pillow head and the plate-like supporting member being normally positioned in the same horizontal plane;

at least one vacuum cover, cooperating with each bag supporting device to form a vacuum box in which the open end of the each bag is sealed under a vacuum and revolving synchronously with said bag supporting device while moving vertically to open and close said vacuum cover having a heating member for sealing the open end of each bag and a plurality of pushing members formed on the inner surface thereof, which abut against the plate-like supporting member to lower the supporting member under the weight of the vacuum cover when the vacuum cover is placed on the bag supporting device; and a device for evacuating the inner space of the vacuum box.

10. An automatic packaging apparatus according to claim 9, wherein each bag supporting device is fixed to an endless chain moving as the travel means around two spaced-apart sprocket wheels, the vacuum covers being provided around the periphery of one of the sprocket wheels at equal space intervals, the upstream end of the feeding device being located directly above the linear span of the traveling path of the chain.

11. An automatic packaging apparatus according to claim 9, wherein a guide rail for generally retaining each bag supporting device horizontally and then tilting said device at a preset position to dump the bag thereon is provided along the traveling path of the chain, the bag supporting device being adapted to pass through the preset position after the bag has been sealed in the vaccum box.

12. An automatic packaging apparatus according to claim 9, wherein each bag supporting device is provided on the periphery of a turn table rotated by a driving mechanism, the feeding device being positioned along a tangent line to the traveling path of the bag supporting device.

13. An automatic packaging apparatus comprising:

a bag forming device for automatically forming bags each containing at least one article; and a vacuum sealing device for sealing open ends of the bags in a vacuum;

said bag forming device further comprising:

a tubular film forming device in the shape of a tubr for continuously forming an elongated sheet of film into a tube of the film and wrapping the articles fed into the tubular film forming device in a line;

a film sealing and cutting device for cutting the tube of film at preset space intervals to form each of the bags, one end of which is completely sealed and the other end of which is partly sealed; and a feeding device for feeding the bags formed by the film sealing and cutting device to the vacum sealing device at a faster speed than that of the travel of the tube;

said vacuum sealing device further comprising:

at least one bag supporting device, revolving synchronously with the feeding device so that each bag supporting device can receive a respective one bag fed by the feeding device along a traveling path and having a pillow head for resting thereon the open end of said bag fed onto the bag supporting device, each bag supporting device having a plate-like supporting member on which the bag is laid, the plate-like supporting member being moved vertically so that it is at a height position close to the lower surface of the feeding device to decrease the distance of drop between the plate-like supporting member and the feeding device when the bag is transferred from the feeding device onto the plate-like supporting member and the plate-like supporting member is at a level lower than that of the upper end of the pillow head to cause the open end of the bag to lie horizontally on the pillow head when the open end thereof is sealed;

at least one vacuum cover, cooperating with each bag supporting device to form a vacuum box in which the open end of each bag is sealed under a vacuum and revolving synchronously with said bag supporting device while moving vertically to open and close said vacuum box, said vacuum cover having a heating member for sealing the open end of each bag; and a device for evacuating the inner space of the vacuum box;

the automatic packaging apparatus further comprising:

pivotable guide body means for transferring of the bags, a guide railing means for retaining each bag supporting device substantially horizontally and tilting said bag supporting device at a preset position to dump the bag thereon is provided along the travelling path of the chain, said bag supporting device having cam means contacting a lever which pivots said guide body means allowing said bag supporting device to pass under said guide body means without collision therebetween, the bag supporting device passing through the preset position after the bag is sealed in the vacuum box.

* * * * *